US008840338B2

(12) United States Patent
Mills et al.

(10) Patent No.: US 8,840,338 B2
(45) Date of Patent: Sep. 23, 2014

(54) FLUID FILLABLE STRUCTURE

(75) Inventors: James Andrew Mills, Edmonton (CA); Gregory Allan Parrent, Edmonton (CA)

(73) Assignee: LAYFIELD Group Ltd., Edmonton (CA)

( * ) Notice: Subject to any disclaimer, the term of this patent is extended or adjusted under 35 U.S.C. 154(b) by 0 days.

(21) Appl. No.: 13/362,199

(22) Filed: Jan. 31, 2012

(65) Prior Publication Data

US 2013/0195556 A1 Aug. 1, 2013

(51) Int. Cl.
*E02B 3/10* (2006.01)
*E02B 7/08* (2006.01)
*E02B 7/14* (2006.01)

(52) U.S. Cl.
USPC ..... 405/111; 405/107; 405/110; 405/115

(58) Field of Classification Search
USPC ..... 405/107, 110, 111, 115; 383/105, 107
See application file for complete search history.

(56) References Cited

U.S. PATENT DOCUMENTS 2,616,467 A * 11/1952 Cicero ..... 383/16
2,669,272 A * 2/1954 Permann ..... 383/6
2,687,158 A * 8/1954 Owen ..... 206/521
3,191,386 A * 6/1965 Wiegel et al. ..... 405/25
3,246,474 A * 4/1966 Mesnager ..... 405/115
3,373,568 A * 3/1968 Hornbostel, Jr. ..... 405/21
3,886,751 A * 6/1975 Porraz Jimenez Labora 405/107
3,922,832 A * 12/1975 Dicker ..... 52/741.15
3,928,980 A * 12/1975 Ganzinotti ..... 405/110
3,957,098 A * 5/1976 Hepworth et al. ..... 383/45
4,362,433 A * 12/1982 Wagner et al. ..... 405/107
4,573,508 A * 3/1986 Knaus ..... 220/562
4,887,541 A 12/1989 Rodemann
4,887,700 A * 12/1989 Rice ..... 190/111
5,059,065 A * 10/1991 Doolaege ..... 405/115
5,125,767 A 6/1992 Dooleage
5,743,674 A * 4/1998 Healy ..... 405/52
5,803,333 A * 9/1998 Fawcett ..... 224/652
5,820,297 A * 10/1998 Middleton ..... 405/52
5,865,564 A * 2/1999 Miller et al. ..... 405/115
5,885,564 A * 3/1999 Zastrow et al. ..... 424/74
5,996,799 A * 12/1999 Garreth et al. ..... 206/521
6,186,701 B1 * 2/2001 Kempers ..... 405/19
6,481,928 B1 * 11/2002 Doolaege ..... 405/115
6,619,884 B2 * 9/2003 Davis et al. ..... 405/111
6,641,329 B1 * 11/2003 Clement ..... 405/115
6,675,998 B2 * 1/2004 Forsman et al. ..... 224/148.2
6,679,654 B1 1/2004 Wittenberg et al.
6,715,960 B2 * 4/2004 Metz ..... 405/116

(Continued)

FOREIGN PATENT DOCUMENTS

GB 2081213 A 2/1982

*Primary Examiner* — John Kreck
*Assistant Examiner* — Edwin Toledo-Duran
(74) *Attorney, Agent, or Firm* — Christensen O'Connor Johnson Kindness PLLC

(57) ABSTRACT

A fluid fillable structure has a reservoir body comprising a top surface and at least one fluid fill port at a first end. There is a first connector on the top surface of the reservoir body adjacent to the first end and a second connector spaced from the first end, the first end of the reservoir body being folded back onto the reservoir body and secured by releasably securing the first connector to the second connector such that the at least one fluid fill port remains open.

25 Claims, 9 Drawing Sheets

(56) References Cited

U.S. PATENT DOCUMENTS

| | | | | |
|---|---|---|---|---|
| 6,739,274 | B2 * | 5/2004 | Eagles et al. | 114/74 T |
| 6,783,300 | B2 | 8/2004 | Dooleage | |
| 6,905,289 | B1 * | 6/2005 | Sanguinetti | 405/302.6 |
| 7,070,075 | B2 * | 7/2006 | Forsman et al. | 224/148.2 |
| 7,762,742 | B1 | 7/2010 | Smith | |
| 2005/0260038 | A1 * | 11/2005 | Sousa Costa | 405/115 |
| 2007/0053752 | A1 * | 3/2007 | Kim | 405/284 |
| 2007/0243021 | A1 | 10/2007 | Tyler | |
| 2008/0138157 | A1 * | 6/2008 | Kim | 405/107 |
| 2010/0014788 | A1 * | 1/2010 | Powell | 383/107 |

* cited by examiner

FLUID FILLABLE STRUCTURE

FIELD

This relates to a fluid fillable structure, such as a structure that may be used as a barrier for flood control.

BACKGROUND

Fluid filled barriers are commonly used in controlling flooding, although they may also be used for other purposes as well. Examples of other fluid filled barriers include U.S. Pat. No. 5,865,564 (Miller et al.) entitled "Fluid-Fillable Barrier"; U.S. Pat. No. 5,059,065 (Doolaege) entitled "Apparatus and a method for joining fluid structure sections or the like"; and U.S. Pat. No. 6,481,928 (Doolaege) entitled "Flexible hydraulic structure and system for replacing a damaged portion thereof".

A known type of fluid filled barrier, generally indicated by reference numeral 100, is shown in FIG. 1, made up of bladders 102. Generally, fluid filled barriers 100 may be between 2-20 feet, but may be more or less than this, depending on the available resources and the demands of each situation. Fluid filled barrier 100 is made up of elongated fluid filled bladders 102 placed end to end, with at least one end 104 open to receive fluid. As shown, end 104 has been gathered to make it easier to fill. In order to keep bladders 102 full, it is necessary to elevate the open end(s) of bladders 102. Once the barrier is being erected, this is done by using adjacent bladders 102 to keep ends 104 elevated. However, this cannot be done for the first bladder 102, such that an elevated structure 106, such as a natural or artificial rise, is used as the starting point for fluid filled barrier 100.

SUMMARY

There is provided a fluid fillable structure, comprising a reservoir body comprising a top surface and at least one fluid fill port at a first end. A first connector is on the top surface of the reservoir body adjacent to the first end and a second connector is spaced from the first end. The first end of the reservoir body is folded back onto the reservoir body and secured by releasably securing the first connector to the second connector such that the at least one fluid fill port remains open.

According to another aspect, the reservoir body may be tapered toward a smaller cross-section at the first end.

According to another aspect, the fluid fillable structure may be in combination with a plurality of elongated fluid filled bladders extending from at least one end of the fluid fillable structure to form an elongated barrier. At least one fluid filled bladder may be a fluid fillable structure.

According to another aspect, the fluid fillable structure may further comprise flexible collars that connect adjacent ends of the fluid fillable structure and the fluid filled bladders. The flexible collars may comprise a flexible apron extending outward from a bottom surface of the flexible collar.

According to another aspect, there may be fluid filling the reservoir body. The first end that is folded onto the reservoir body may be partially filled with the fluid.

According to another aspect, the first end may be folded at a fold line, and the top surface of the reservoir body may be sloped downward between the second connector and the fold line when the reservoir body is filled with fluid.

According to another aspect, the first and second connectors may be selected from a group consisting of tape fasteners, buckles, or restraints engaged by a third connector.

According to another aspect, there may be at least one fill tube inserted into each of the at least one fluid fill port.

According to another aspect, the reservoir body may comprise a fluid tight bladder supported by a structural substrate.

According to another aspect, a bottom surface at the first end of the reservoir body may be unrestrained by securing the first connector to the second connector.

According to another aspect, there is provided a method of installing an elongated barrier, comprising the steps of: providing a fluid fillable structure as described above; folding the first end of the reservoir body back onto the reservoir body and securing the folded portion in place by releasably securing the first connector to the second connector, such that the at least one fluid fill port remains open; and injecting fluid into the reservoir body through the at least one fluid fill port located on the top surface of the reservoir body.

According to another aspect, the method may further comprise the step of installing a plurality of fluid filled bladders that extend from the fluid fillable structure. At least one fluid filled bladder may be a fluid fillable structure.

According to another aspect, the step of injecting fluid may comprise partially filling the first end that is folded onto the reservoir body with fluid.

According to another aspect, the first end may be folded at a fold line, and the top surface of the reservoir body may slope downward between the second connector and the fold line after fluid is injected.

According to another aspect, providing a fluid fillable structure may comprise inserting at least one fill tube into each of the at least one fluid fill port. The tubes may be removed.

According to another aspect, the first connector may be secured to the second connector such that a bottom surface at the first end of the reservoir body is unrestrained.

According to another aspect, the method may further comprise the steps of releasing the first connector and the second connector and emptying the reservoir body through the fluid fill ports.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
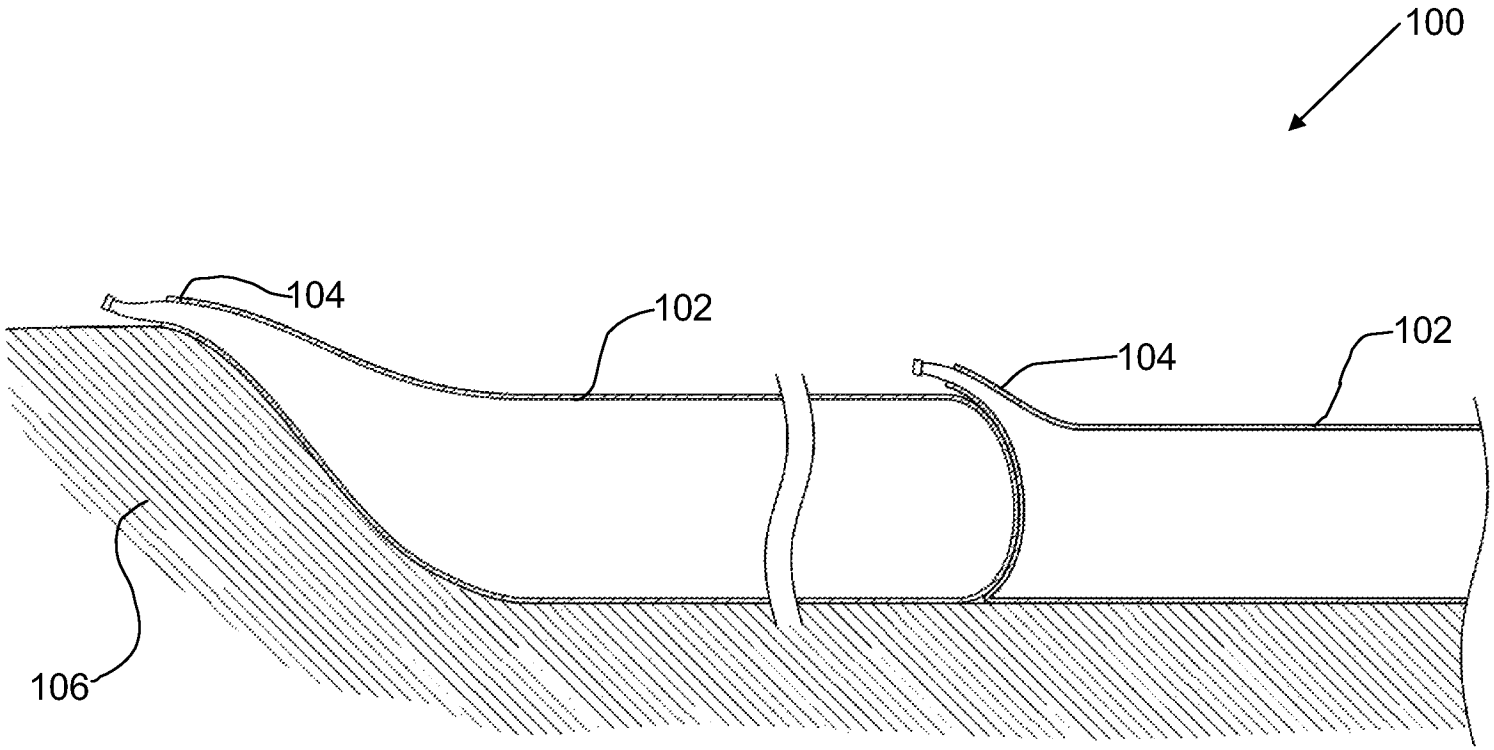
FIG. 1 (Prior Art)
FIG. 1 is a side elevation view of a prior art fluid filled barrier.

A fluid fillable structure generally identified by reference numeral 10, will now be described with reference to FIG. 2 through 8C. The structures discussed herein are described as being filled with a fluid. Generally, this fluid will be water, as this is the most accessible and cheapest fluid available. However, it will be understood that the term "fluid" may include other fluids that may also be used to fill these barriers, and that may be obtained from various sources. In addition, structure 10 may be used for other purposes, such as to store fluid, in which case it may be filled with any fluid that may be appropriately stored. The types of fluid and methods of transporting these fluids will be known to those skilled in the art.

Figure 2:
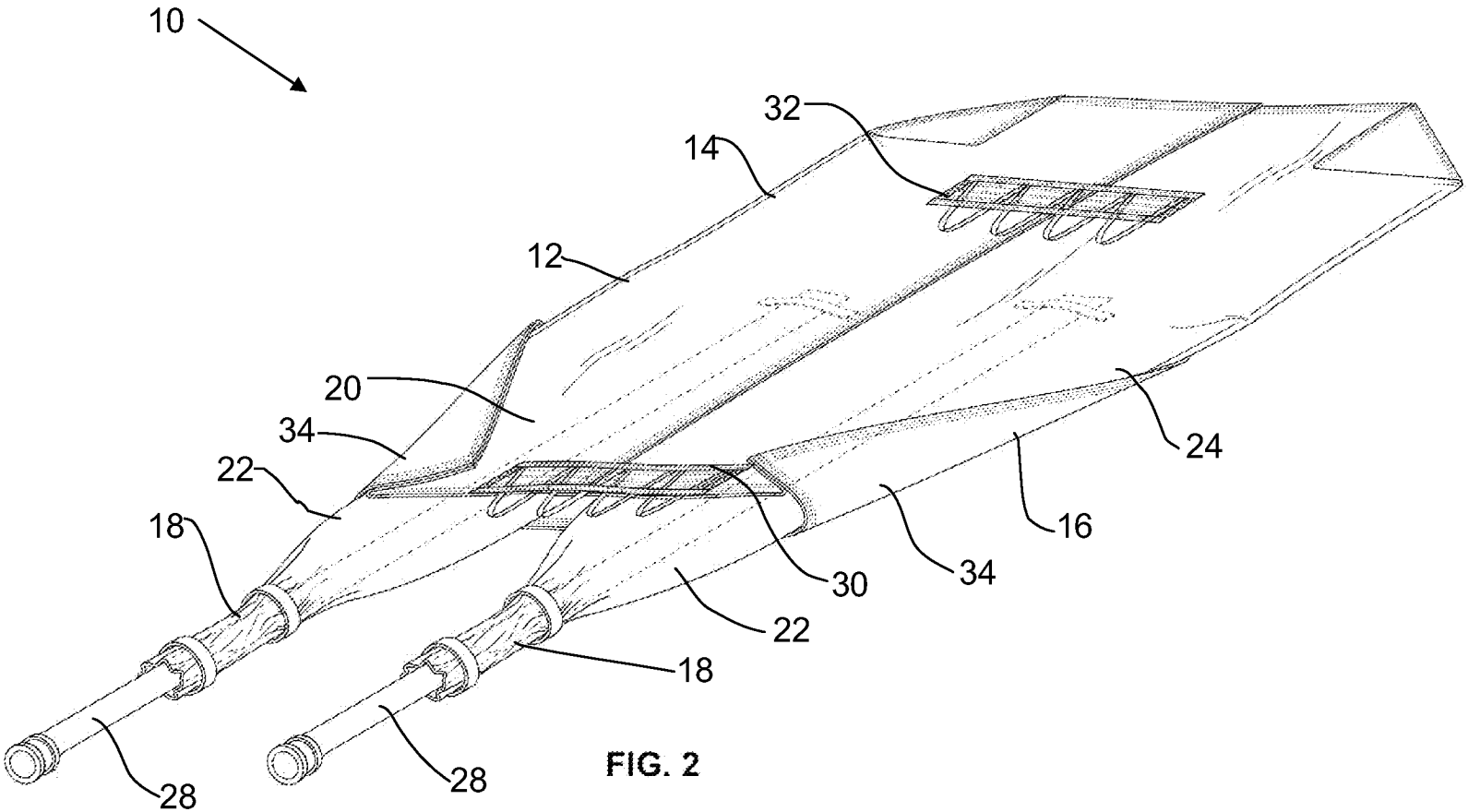
FIG. 2 is a perspective view of an empty, unfolded fluid fillable structure.

Referring to FIG. 2, fluid fillable structure 10 has a reservoir body 12 with a top surface 14 that acts as a top tie-back surface, a bottom surface 16, and at least one fluid fill port 18 at a first end 20 that acts as a fluid filling end. The term "first end" as used herein is not intended to refer exclusively to the edge of body 12, but rather the general area at one end of body 12, as will become apparent during the discussion of how fluid fillable structure 10 is assembled.

Figure 4:
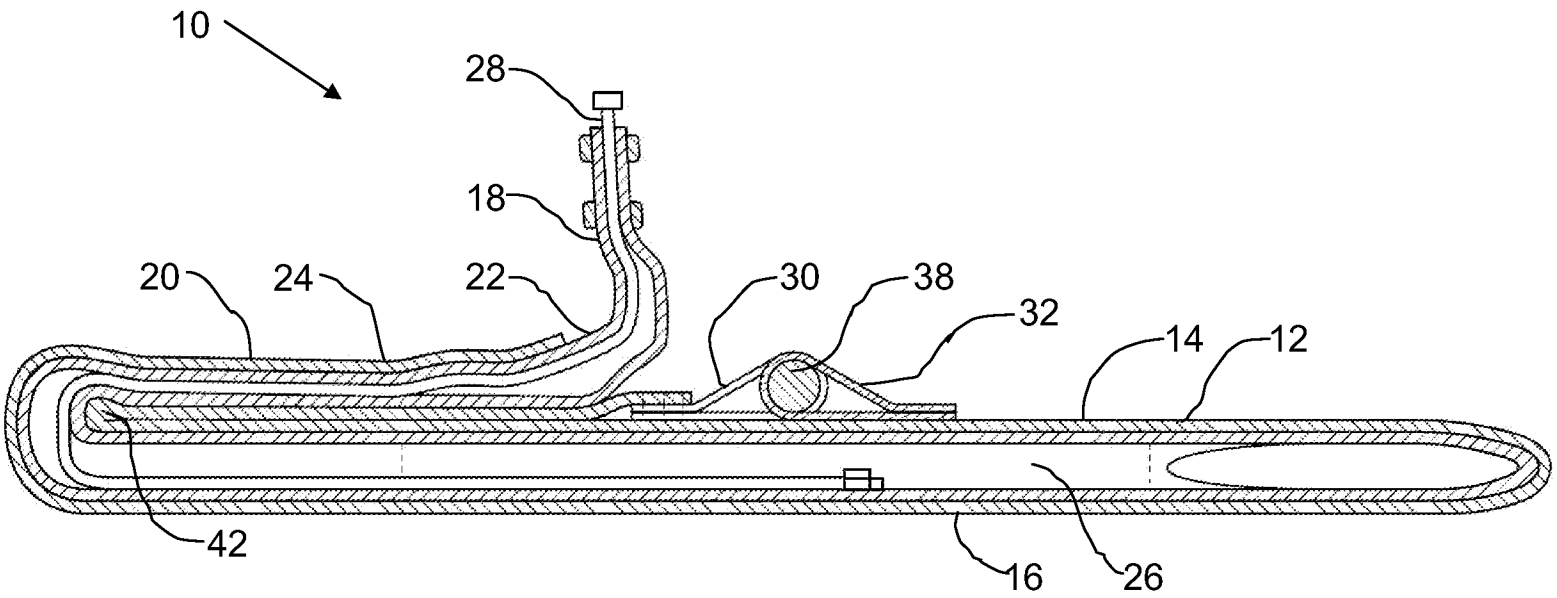
FIG. 4 is a side elevation view in section of a fluid fillable structure.

Reservoir body 12 must be capable of retaining fluid, and also withstanding the weight of the fluid without failure. Referring to FIG. 4, one example of reservoir body 12 has an inner, impermeable liner 22 and an outer, structural sleeve 24, each made from a flexible substrate with the necessary properties. For example, impermeable liner 22 may be plastic polyethylene sheeting, while the structural sleeve may be made from a polypropylene fabric. Other suitable materials will be recognized by those skilled in the art. Furthermore, reservoir body may be made from a single layer of material that provides both the fluid retaining and structural properties. In a preferred design, impermeable liner 22 is a U-shaped tube with both open ends of the U-shaped tube at first end 20 of body 12. The U-shaped liner 22 may be separated by a baffle 26 attached to structural sleeve. This is done to enhance the stability of reservoir body 12 and to prevent it from moving due to lateral forces. Other designs and variations of the aspects mentioned above will be recognized by those skilled in the art.

Referring to FIG. 4, the depicted example, fill lines 28 have been inserted through fill ports 18 and extend into reservoir body 12. In this example, impermeable liner 22 has been gathered and taped to fill lines 28. This is done for convenience, as a fluid pump, such as a water pump, can then be easily connected to fill lines 28, and the necessary volume of fluid injected. Once filled, the tape can be removed and fill lines 28 withdrawn from reservoir body 12. Fill lines 28 may also be left in place until it is desired to empty reservoir body 12 in order to allow more fluid to be injected in the event that body 12 requires additional fluid due to a leak, under filling, etc. Once removed, fluid fill ports 18 preferably expand to a larger size, which allows water to exit reservoir body 12 more rapidly.

Figure 3:
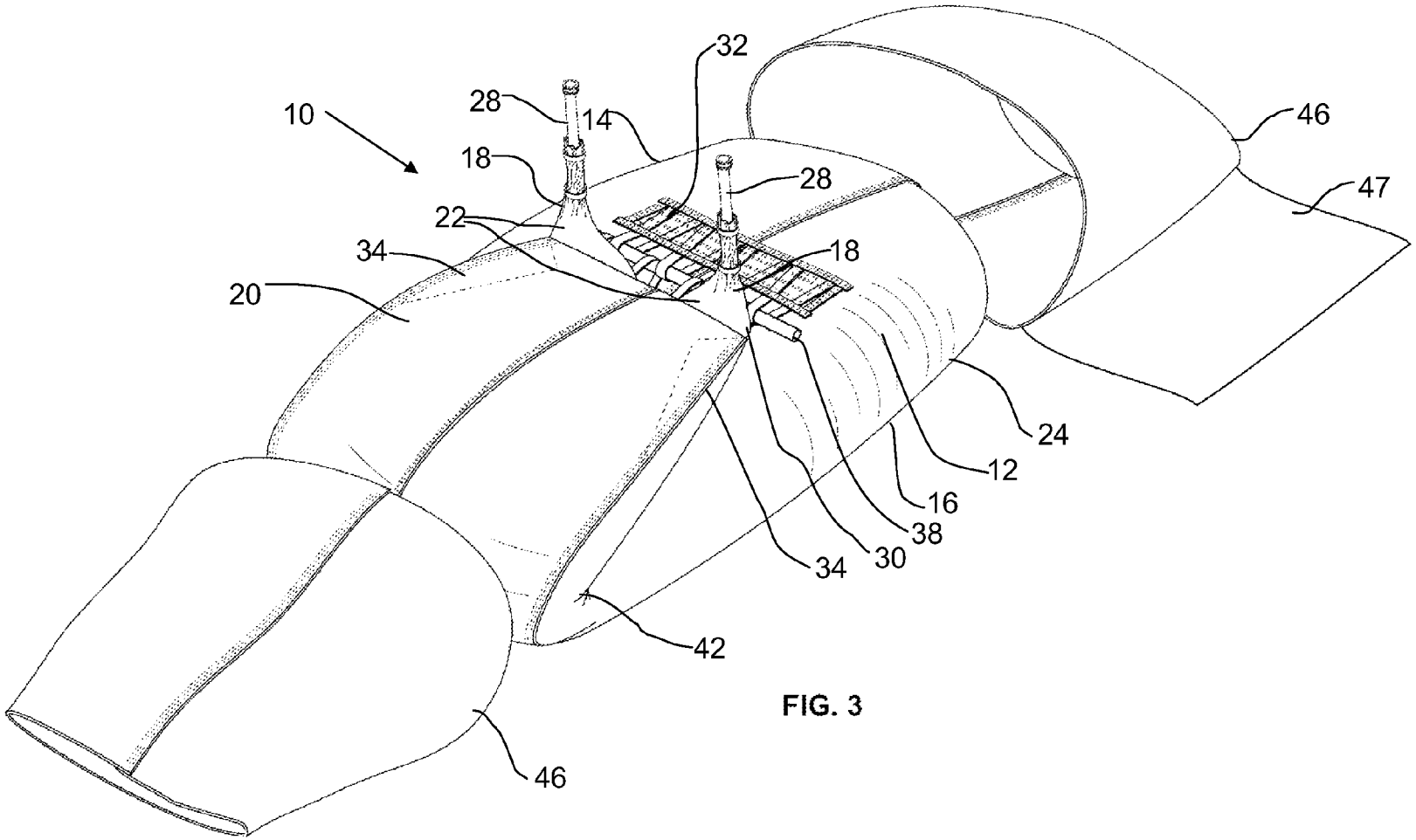
FIG. 3 is an exploded perspective view of a filled fluid fillable structure.

Referring now to FIG. 2 and FIG. 3, there is a first connector 30 on top surface 14 of reservoir body 12 at first end 20 and a second connector 32 spaced from first end 20. Fluid fillable structure 10 is prepared for use by folding first end 20 of reservoir body 12 back onto the remainder of reservoir body 12 and secured in place by releasably securing first connector 30 to second connector 32. This is done while maintaining fill port 18 open to receive fluid. If this is done in a factory or other off-site location, reservoir body 12 may then be rolled up or otherwise packaged and prepared to be transported to where it is needed. This may also be done on site prior to filling reservoir body 12 with fluid.

As will be understood, first end 20 of reservoir body 12 is defined by the portion that is folded over onto reservoir body 12. As can be seen, first connector 30 is attached to what is considered the top surface 14 of reservoir body 12 in the unfolded position, but becomes the bottom surface of first end 20 once it is folded over onto itself. As can be seen in FIG. 2, first end 20 of reservoir body 12 includes a taper 34 toward the fill ports 18. This is done to help prevent fluid escaping once body 12 is filled. As can be seen in FIG. 3, once filled, top surface 14 of body 12 is rounded. Taper 34 is designed to keep fill ports 18 from extending down the sides of body 12, which could allow fluid to escape unintentionally.

Figure 8:
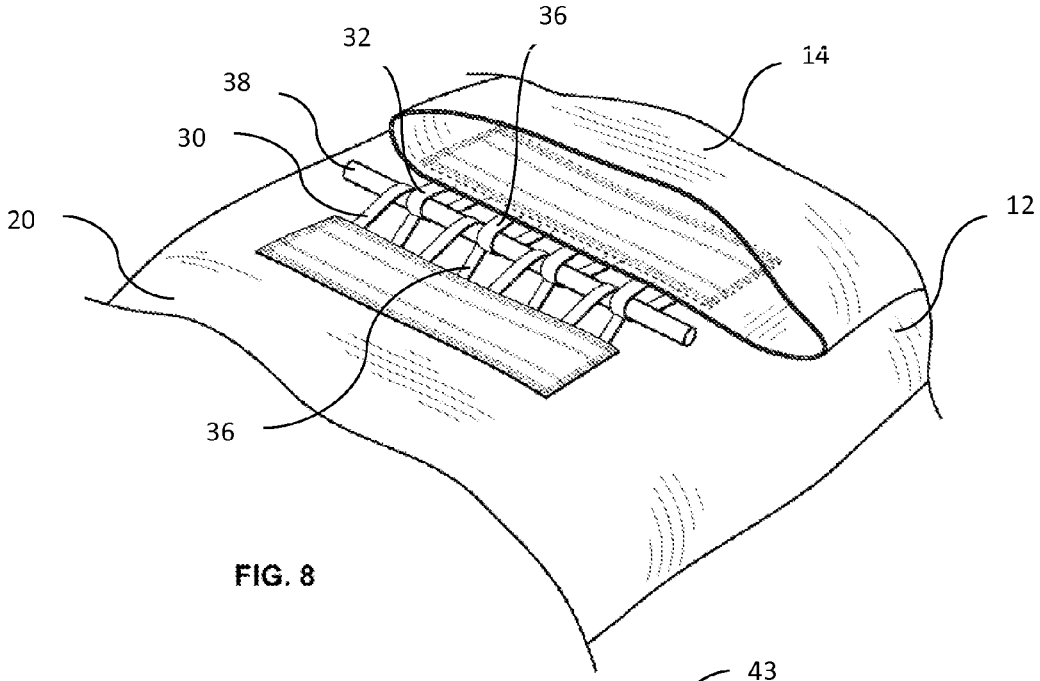
FIG. 8-8C are detailed perspective views of various attachments.
Figure 8A:
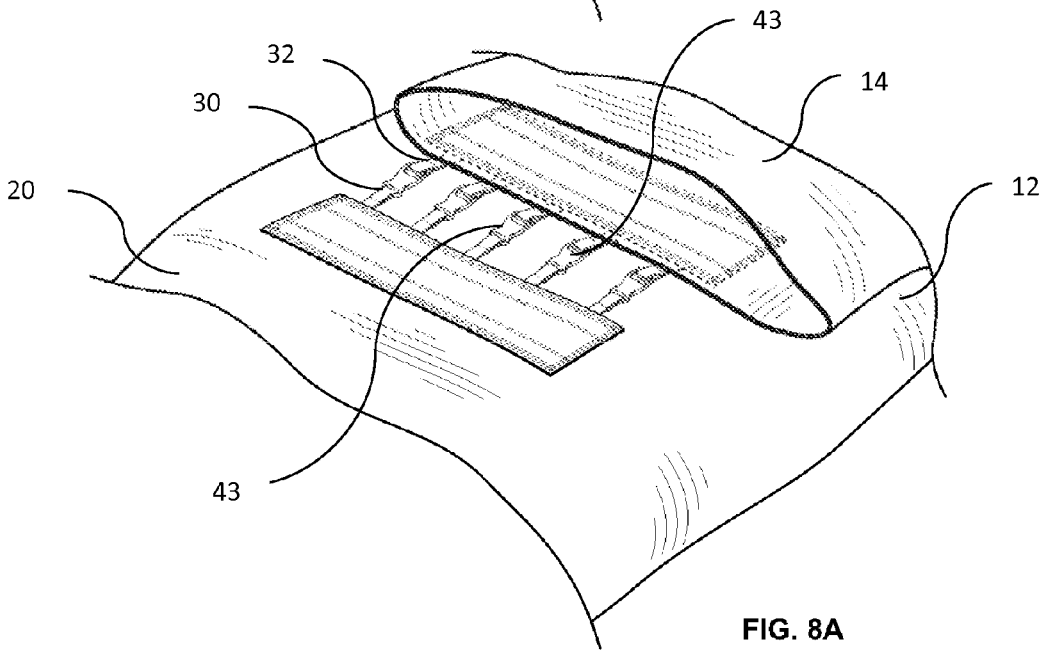
Figure 8B:
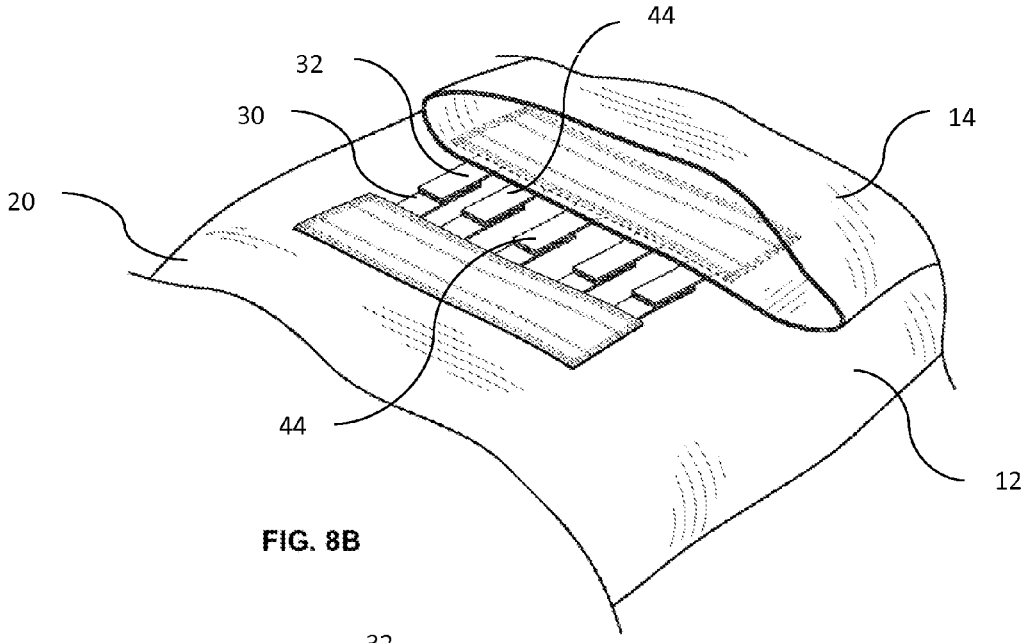
Figure 8C:
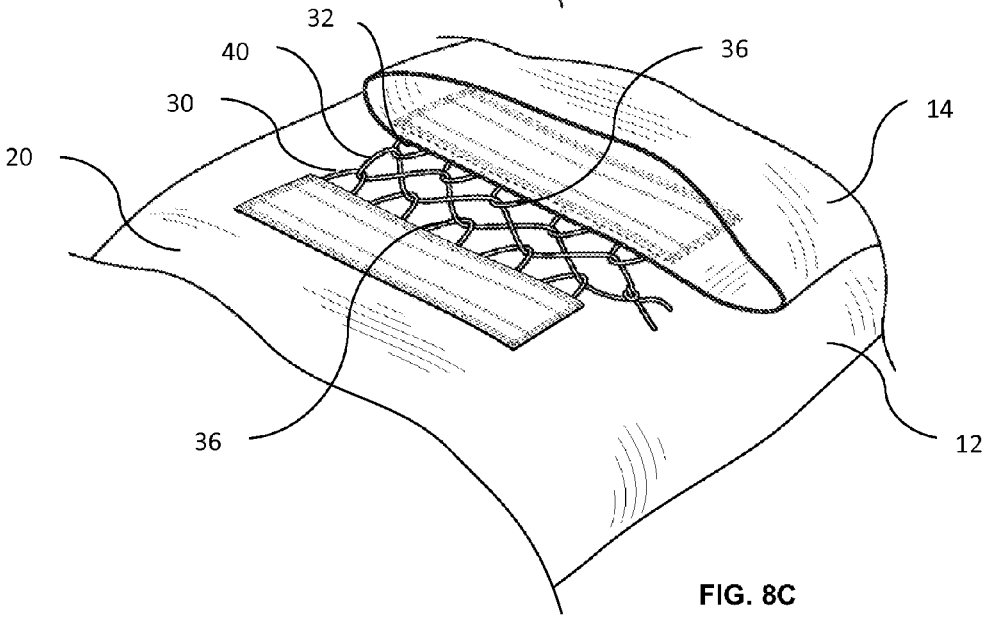

First and second connectors 30 and 32 may take different forms. Referring to FIG. 8 through 8C, different examples are shown. It will be understood that these examples are intended to represent different classes of connections, and the examples provided are not intended to be exhaustive as there are many different types of connectors that could be used, the exact details of which are largely unimportant aside from concerns regarding practicality, ease of use, cost and preferences of the user. Referring to FIG. 8, a first example includes two sets of loops 36 with a rigid connector 38 extending through loops 36. Rigid connector 38, such as a length of pipe, may be considered a third connector, which is used to secure connectors 30 and 32. Referring to FIG. 8A, a third connector may also be a cable 40, which is shown connecting a different style of loop 36. The benefit of using a third connector, such as rigid connector 38 or flexible connector 40, is that the connection connectors between 30 and 32 may be released by an operator from one side of reservoir body 12, without having to reach across or mount body 12. Other types of restraints may include buckles 42 shown in FIG. 8C, tape fasteners, such as hook and loop fasteners 44 shown in FIG. 8C, or other known types of connectors, or variations of the connectors shown. For example, different types of buckles may replace those shown in FIG. 8B, or a full length of hook and loop fasteners 44 may be used rather than discrete straps. In any event each connector must be properly secured to its respective portion of body 12, and be sufficiently strong to withstand the weight and pressure the fluid will apply to body 12 in order to maintain first end 20 in the desired position.

The example of structure 10 depicted in the drawings is designed such that the fluid within body 12 may be released quickly and efficiently by removing line 28 and allowing ports 18 to open to the greatest extent, and releasing connectors 30 and 32. When this occurs, first end 20 will be pushed out and down due to fluid pressure, and the fluid will then exit body 12. The remaining fluid may be removed by rolling up body 12 toward first end 20, such that body 12 is completely empty. This allows structure 10 to be transported and reused at another location without any additional steps required to repair or otherwise prepare structure 10 beyond the initial installation.

As can be seen, the connection between first and second connectors 30 and 32 leaves fluid fill ports 18 open to be filled after body 12 has been properly folded and assembled. In the depicted examples, aside from being integrally formed with the attached portion, the opposite side of fluid fill ports 18 is left unrestrained with respect to body 12, with only the one edge of fluid fill port 18 being securely held against body 12. It will be apparent that fluid fill ports 18 may be closed after body 12 has been filled to the appropriate level, although this may not be necessary as the fill ports 18 will be maintained above the fluid level in body 12 at all times in any event.

Figure 5:
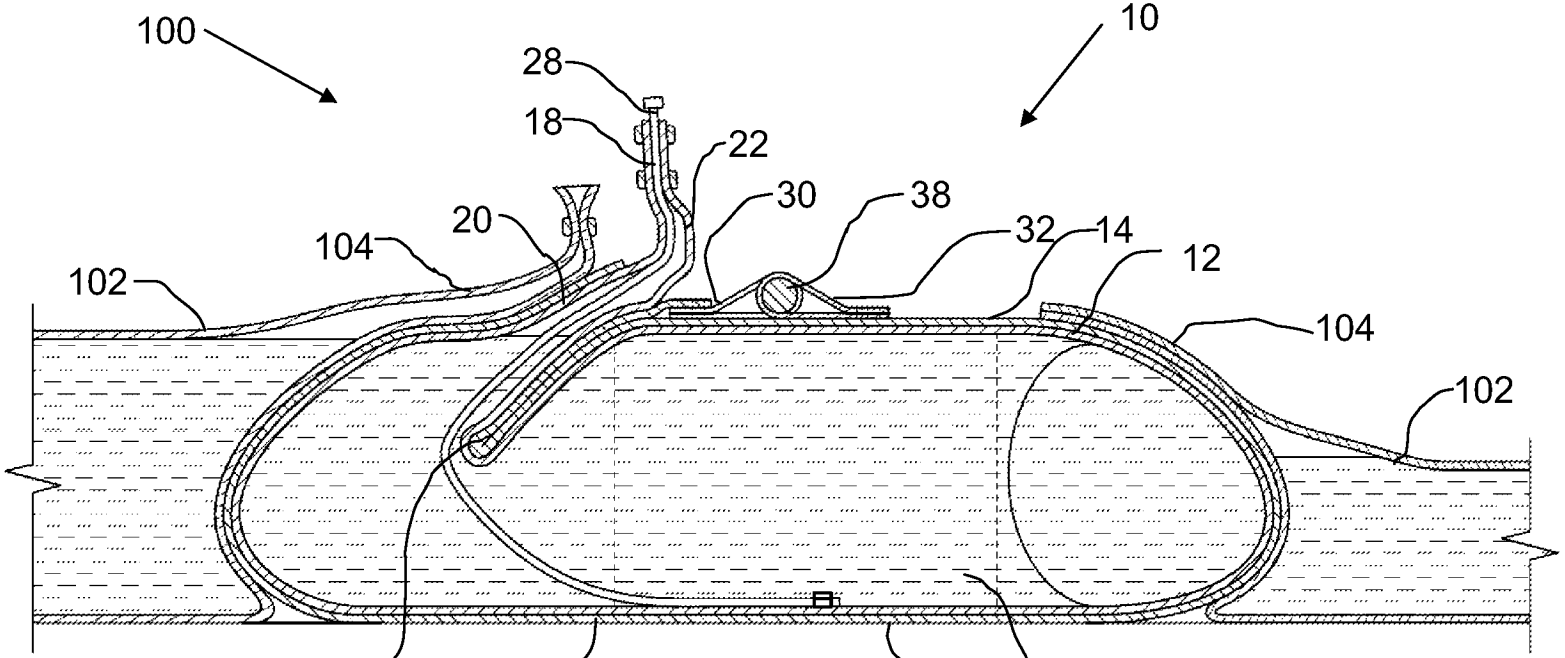
FIG. 5 is a side elevation view in section of a filled fluid fillable structure as part of a fluid filled barrier.

Referring to FIGS. 3 and 5, first end 20 is folded over at what may be described as a fold line 42, although in most cases fold line 42 will not be defined until the fold occurs. When body 12 is filled with fluid, the fold line will be kept about half-way up the height of body 12, although the actual height may vary depending on the design of body 12. This is due to the fact that fluid will be present in first end 20, which has been folded over body 12. In other words, top surface 14 of body 12 will slope downward starting at about second connector 32 toward fold line 42. Thus, the main, or unfolded, portion of body 12 will not necessarily retain all the fluid in body 12, as a portion will generally be present in first end 20.

Figure 6:
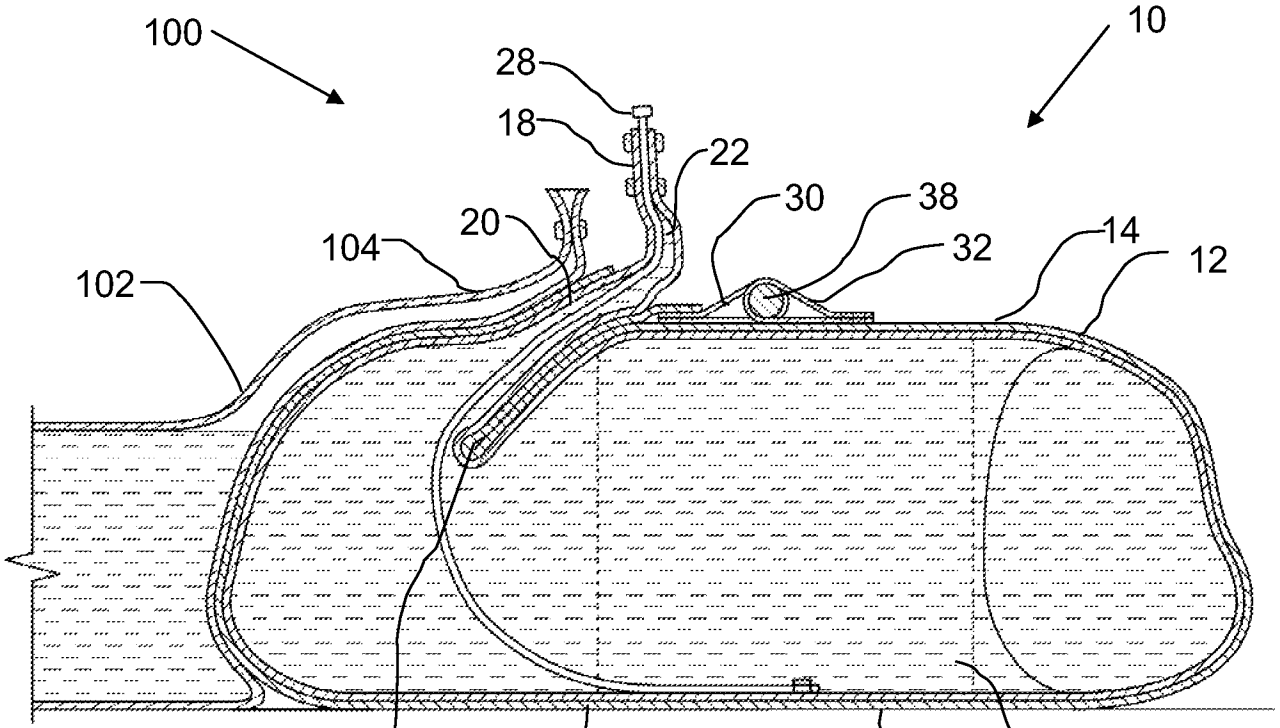
FIG. 6 is a side elevation view in section of a filled alternative fluid fillable structure.
Figure 7:
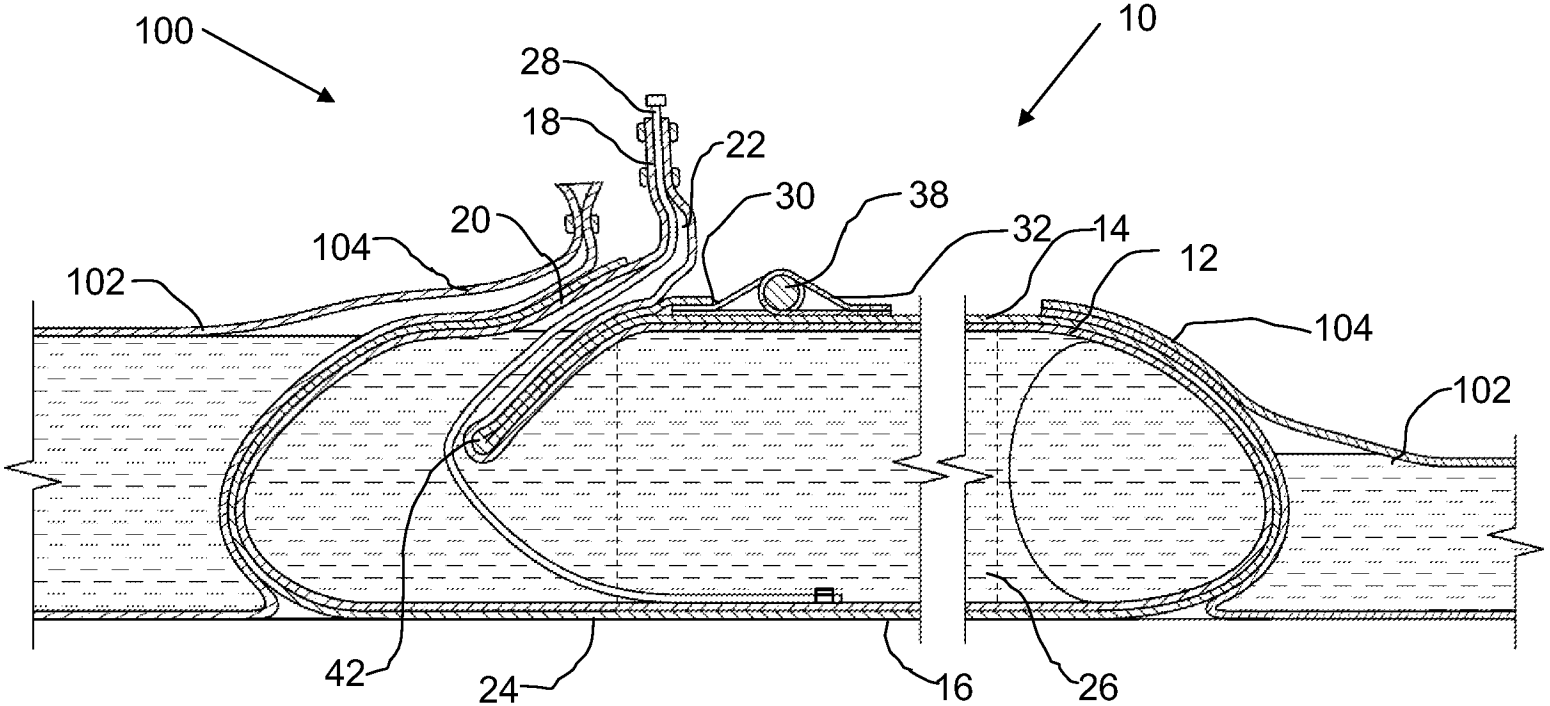
FIG. 7 is a side elevation view in section of a filled further alternative fluid fillable structure.

Referring to FIG. 5, fluid fillable structure 10 is intended to be a part of a fluid barrier 100, generally made up of multiple, discrete lengths of barriers. As shown, fluid fillable structure 10 is positioned between two bladders 102, which extend away from either end of structure 10. It will be understood that, when used as a starter dam, fluid fillable structure 10 may also be positioned at an angle to fluid barrier 100, such that bladders 102 extend from the sides of fluid fillable structure 10 rather than the ends. Bladder 102 on the left is filled, while bladder 102 on the right is being filled. Generally, sections of a fluid barrier 100 will be filled sequentially. When used as a "starter dam" to replace elevated structure 106 shown in FIG. 1, there may only be a bladder 102 extending away from one end of structure 10. As shown, fluid fillable structure 10 is an intermediate component in the entire barrier 100. This may be useful to protect against a general failure of barrier 100 should one bladder 102 fail, as structure 10 does not rely on an adjacent bladder to keep fill port 18 raised above the fluid level in bladders 100 or structure 10. Alternatively, referring to FIG. 6, structure 10 may be higher than the adjacent bladders 102 to provide a higher reference point. It has been found that subsequent sections of barrier 100 tend to decrease slightly in their maximum height, as it is difficult to maintain the same fluid level in adjacent bladders. For example, if one bladder has a height of 3 feet, the adjacent bladder may only be at 2 feet, 11 inches. By providing an oversized structure 10, this risk is reduced. As a further alternative, referring to FIG. 7, structure 10 may be of indeterminate length, and may be the same length as a normal section of barrier 100. This approach may be used if the entire barrier 100 is to be made from structures 10, rather than only using structure 10 as a starter dam, or periodically provided to protect structure 10 against general failure or to recover any lost height. Referring to FIG. 3, fluid filled structure 10 may be secured to adjacent sections of barrier 100 by a collar 46 to increase stability, as is known in the art. Alternatively, collar 46 may also have an apron 47 that extends outward from the bottom surface of collar 46, as shown on the right-hand collar 46. Apron 47 and collar 46 are both preferably made from flexible, impermeable material and can thus reduce the amount of leakage through the small opening that exists between adjacent structures 10 and/or bladders 102 (see, for example, FIG. 5). Apron 47 extends along the ground surface toward the fluid being retained. The fluid pressure from the retained fluid presses down on apron 47, and effectively seals the small opening between structures 10 and/or bladders 102.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A fluid fillable structure, comprising:

a reservoir body comprising a top tie-back surface, a bottom surface, and at least one fluid fill port at a fluid filling end; and first and second connectors on the top tie-back surface, wherein the first connector is positioned adjacent to the fluid filling end and the second connector is spaced from the fluid filling end, wherein the at least one fluid fill port, the fluid filling end of the reservoir body, and the first connector are folded back onto the reservoir body and secured by releasably securing the first connector to the second connector, such that the at least one fluid fill port is positioned on top of the reservoir body above the first and second connectors and remains open, the at least one fluid fill port remaining open when the reservoir body is filled with fluid, wherein the fluid fillable structure in combination with a plurality of elongated fluid filled bladders extending from the fluid fillable structure form an elongated flood control barrier.

2. The fluid fillable structure of claim 1, wherein the reservoir body is tapered from a point between the first and second connectors toward a smaller cross-section at the fluid filling end.

3. The fluid fillable structure of claim 1, wherein at least one of the plurality of fluid filled bladders is a fluid fillable structure.

4. The fluid fillable structure of claim 1, further comprising flexible collars that connect adjacent ends of the fluid fillable structure and the plurality of fluid filled bladders.

5. The fluid fillable structure of claim 4, wherein each of the flexible collars have a flexible apron extending outward from a bottom surface of the flexible collar.

6. The fluid fillable structure of claim 1, further comprising fluid filling the reservoir body, wherein the fluid filling end that is folded onto the reservoir body is partially filled with the fluid.

7. The fluid fillable structure of claim 4, wherein the fluid filling end is folded at a fold line, the top tie-back surface of the reservoir body sloping downward between the second connector and the fold line when the reservoir body is filled with fluid.

8. The fluid fillable structure of claim 1, wherein the first and second connectors are selected from a group consisting of tape fasteners, buckles, or first and second restraints connected by a third connector.

9. The fluid fillable structure of claim 1, further comprising at least one fill tube inserted into each of the at least one fluid fill port.

10. The fluid fillable structure of claim 1, wherein the reservoir body comprises a fluid tight bladder supported by a structural substrate.

11. The fluid fillable structure of claim 1, wherein a bottom surface at the fluid filling end of the reservoir body is unrestrained by securing the first connector to the second connector.

12. A method of installing a fluid fillable structure, comprising the steps of:

providing a fluid fillable structure comprising a reservoir body comprising a top tie-back surface, a bottom surface, and at least one fluid fill port at a fluid filling end, first and second connectors on the top tie-back surface, wherein the first connector is positioned adjacent to the fluid filling end and the second connector is spaced from the fluid filling end and the first connector;

folding the at least one fluid fill port, the fluid filling end of the reservoir body, and the first connector back onto the top tie-back surface of the reservoir body and securing the folded portion in place by releasably securing the first connector to the second connector, such that the at least one fluid fill port is positioned on top of the reservoir body above the first and second connectors and is unimpeded by the first and second connectors;

injecting fluid into the reservoir body through the at least one fluid fill port located on the top surface of the reservoir body, the at least one fluid fill port remaining open when the reservoir body is filled with fluid; and installing a plurality of fluid filled bladders that extend from the fluid fillable structure to form an elongated flood control barrier.

13. The method of claim 12, wherein the reservoir body is tapered from a point between the first and second connectors toward a smaller cross-section at the fluid filling end and comprises a consistent diameter otherwise.

14. The method of claim 12, wherein at least one of the plurality of fluid filled bladders is a fluid fillable structure.

15. The method of claim 12, further comprising the step of installing flexible collars to connect adjacent ends of the fluid fillable structure and the plurality of fluid filled bladders.

16. The method of claim 15, wherein the flexible collars have a flexible apron extending outward from a bottom surface of the flexible collar.

17. The method of claim 12, wherein injecting fluid comprises partially filling the fluid filling end that is folded onto the reservoir body with fluid.

18. The method of claim 17, wherein the fluid filling end is folded at a fold line, the top tie-back surface of the reservoir body sloping downward between the second connector and the fold line after fluid is injected.

19. The method of claim 12, wherein the first and second connectors are selected from a group consisting of tape fasteners, buckles, or first and second restraints connected by a third connector.

20. The method of claim 12, wherein providing a fluid fillable structure comprises inserting at least one fill tube into each of the at least one fluid fill port.

21. The method of claim 20, further comprising the step of removing the at least one fill tube.

22. The method of claim 12, wherein the reservoir body comprises a fluid tight bladder supported by a structural substrate.

23. The method of claim 12, wherein the first connector is secured to the second connector such that a bottom surface at the fluid filling end of the reservoir body is unrestrained.

24. The method of claim 12, further comprising the steps of releasing the first connector and the second connector and emptying the reservoir body through the at least one fluid fill port.

25. The method of claim 12, wherein the distance between the first and second connectors is about twice the height of the fluid fillable structure.

* * * * *